US005186254A

United States Patent [19]

van Staden

[11] Patent Number: 5,186,254

[45] Date of Patent: Feb. 16, 1993

[54] BOREHOLE PUMPING INSTALLATION

[76] Inventor: Pieter R. van Staden, 16 Pasteur Drive, Hospitaalpark, Bloemfontein, Orange Free State, South Africa

[21] Appl. No.: 616,055

[22] Filed: Nov. 20, 1990

[30] Foreign Application Priority Data

Nov. 22, 1989 [ZA] South Africa ..... 89/8918

[51] Int. Cl.[5] ..... E21B 43/00; F04B 47/00

[52] U.S. Cl. ..... 166/105; 417/552

[58] Field of Search ..... 166/68, 68.5, 105, 107; 417/552, 553

[56] References Cited

U.S. PATENT DOCUMENTS

| | | | |
|---|---|---|---|
| 2,096,227 | 10/1937 | De Weal | 417/552 X |
| 2,180,366 | 11/1939 | Reichert | 417/552 X |
| 2,356,207 | 8/1944 | Bridwell | 417/552 |
| 2,729,170 | 1/1956 | Tucker | 417/552 |
| 2,982,355 | 5/1961 | Rodgers | 166/105 X |

FOREIGN PATENT DOCUMENTS

| | | |
|---|---|---|
| 1181266 | of 0000 | Australia . |
| 1643470 | of 0000 | Australia . |
| 2624549 | of 0000 | Australia . |
| 3862378 | of 0000 | Australia . |
| 3898778 | of 0000 | Australia . |
| 5206979 | of 0000 | Australia . |

*Primary Examiner*—William P. Neuder
*Attorney, Agent, or Firm*—Ladas & Parry

[57] ABSTRACT

A borehole pumping installation comprises a borehole and a pump located down the borehole so that it is at least partially submerged in water in the borehole. The pump has a reciprocable piston or plunger such that on reciprocation of the piston or plunger, water is urged out of a pump outlet. An elongate member is connected to the piston or plunger and extends up the borehole so that, on reciprocation of the elongate member, the plunger or piston moves in reciprocating fashion. A flexible water conduit or casing leads from the pump outlet along the borehole to the surface. Reciprocating drive means is operatively connected to the elongate member.

16 Claims, 3 Drawing Sheets

BOREHOLE PUMPING INSTALLATION

This invention relates to a borehole pumping installation. It relates also to a borehole pump, anchoring means for anchoring a borehole pump in a borehole, and water pressurizing means attachable to a borehole casing.

The Applicant is aware of a borehole pumping installation, which comprises a water pump located down a borehole and at least partially submerged in water in the borehole, a steel pipeline leading from the pump up the borehole and along which water is pumped from the pump to the surface, a rigid steel pump rod extending from the pump up the borehole to the surface, the lower end of the rod being connected to the pump or plunger of the pump such that, on reciprocation of the pump rod, water is pumped up the pipe, and reciprocating drive means for reciprocating the pump rod. However, this installation has the drawbacks that the pump rod and pipe are subject to corrosion and have to be replaced from time to time, which is laborious and expensive, especially since pipe and rod joints between pipe and rod sections making up the pipeline and rod respectively are usually, due to corrosion, locked together very solidly.

It is hence an object of this invention to provide a borehole pumping installation whereby these drawbacks are at least reduced.

According to a first aspect of the invention, there is provided a borehole pumping installation, which comprises a borehole;

a pump located down the borehole so that it is at least partially submerged in water in the borehole, the pump having a reciprocable piston or plunger such that on reciprocation of the piston or plunger, water is urged out of a pump outlet;

an elongate member connected to the piston or plunger and extending up the borehole so that, on reciprocation of the elongate member, the plunger or piston moves in reciprocating fashion;

a flexible water conduit or casing leading from the pump outlet along the borehole to the surface; and reciprocating drive means operatively connected to the elongate member.

The installation may include anchoring means anchoring the pump in position in the borehole. The anchoring means may comprise an anchoring component, and attachment means attaching the anchoring component to the pump.

In one embodiment of the invention, the anchoring component may comprise an annular body located around the pump. The body may be solid, i.e. in the form of a weight.

In another embodiment of the invention, the anchoring component may be a solid mass located adjacent the pump.

In yet another embodiment of the invention, the anchoring component may comprise at least one gripping member in an extended configuration and gripping the borehole wall, the gripping member being movable from the extended configuration to a retracted configuration in which it disengages the wall. The anchoring means may then also comprise actuating means for moving the gripping formation.

A plurality of the gripping members, staggered circumferentially, may then be provided, with the attachment means comprising at least one sleeve slidably located around a component of the pump, and connecting means connecting the gripping members to the sleeve, and with the actuating member comprising a cable extending up the borehole. Instead, the gripping member may be an inflatable ring around the pump, with the actuating means being a conduit leading from the ring up the borehole and through which air can be pumped into the ring to inflate it into gripping engagement with the borehole wall.

The drive means may be located above ground, and may be in the form of a windmill, reciprocating motor assembly or a manually operable pivotal lever arrangement. The conduit or casing will hence extend from the pump, up the borehole, and out of the borehole. The elongate member may extend along the inside of the casing, or alongside the casing.

The casing may be of plastics or rubber material. The elongate member may also be flexible, and may also be of plastics material. Instead, it may be in the form of a steel cable.

In one embodiment of the invention, the pump may comprise a housing defining a pump chamber and having an inlet to the chamber as well as an outlet from the chamber, with the outlet being spaced from the inlet and the piston being located between the inlet and the outlet so that a first zone is provided in the chamber between the inlet and the piston and a second zone between the outlet and the piston, the piston being displaceable towards and away from the inlet and outlet respectively while engaging sealingly against the inside of the housing, and the piston further being displaceable towards the outlet by the elongate member;

first valve means associated with the piston, the first valve means being adapted to permit fluid to pass from the first to the second zone on the piston being displaced towards the inlet and to prevent fluid passing between the zones on the piston moving towards the outlet;

second valve means associated with the inlet, the second valve means being adapted to permit fluid flow into the first zone through the inlet on the piston being displaced towards the outlet, and to prevent fluid flow from the first zone through the inlet on the piston being displaced towards the inlet; and bias means for biasing the piston towards the inlet.

The housing may be of cylindrical form, with the inlet and outlet being provided at the respective ends of the housing so that the inlet is aligned axially with the outlet. The bias means may comprise a spring extending between the piston and the housing in the first zone, or between the piston and an anchoring member protruding from the housing.

The first valve means may comprise an opening in the piston, and an openable closure member for closing off the opening when the piston moves towards the outlet.

The second valve means may also comprise an openable closure member for closing off the inlet when the piston moves towards the inlet.

In another embodiment of the invention, the pump may comprise an elongate upright housing defining a pump chamber and having an inlet to the chamber at its upper end as well as an outlet from the chamber, with the outlet being spaced from the inlet, the piston being displaceable along the housing towards and away from the outlet while engaging sealingly against the inside of the housing, and the inlet being located between the piston and the outlet;

a piston rod depending downwardly from the piston through an opening in the pump housing;

a connecting member leading from the piston rod outside the pump housing and to which the elongate member is connected;

first valve means associated with the outlet and adapted to permit water to pass from the pump chamber up the flexible conduit on the piston being displaced towards the outlet and to prevent fluid from passing from the conduit back into the pump chamber on the pump being displaced away from the outlet;

second valve means associated with the inlet and adapted to permit fluid flow into the chamber through the inlet on the piston being displaced away from the outlet, and to prevent fluid flow from the chamber through the inlet on the piston being displaced towards the outlet; and bias means for biasing the piston away from the outlet.

The valve means may each comprise an openable closure member for the inlet and outlet.

The installation may include a water take-off from the casing above the borehole, and water pressurizing means attached to the casing above the water take-off. The pressurizing means may comprise an elongate housing, the housing being attached to the casing so that it extends upwardly;

a cylindrical surface within the housing and defining a water chamber;

a sleeve located with clearance within the water chamber so that an annular space is defined between the sleeve and the cylindrical surface, with the sleeve being movable longitudinally with respect to the housing and the cylindrical surface, the operatively upper end of the sleeve being attached to the reciprocating drive means, and the elongate member passing into the operatively lower end thereof and being held captive by the sleeve; and a piston attached to the sleeve and engaging the cylindrical surface sealingly yet slidingly, so that during the up stroke of the drive means water can enter the water chamber below the piston, with this water serving to pressurize water flowing along the take-off during the downstroke.

According to a second aspect of the invention, there is provided a borehole pump, which comprises a housing defining a pump chamber and having an inlet to the chamber as well as an outlet from the chamber, with the outlet being spaced from the inlet;

a piston located between the inlet and the outlet so that a first zone is provided in the chamber between the inlet and the piston and a second zone between the outlet and the piston, with the piston being displaceable towards and away from the inlet and outlet respectively while engaging sealingly against the inside of the housing;

first valve means associated with the piston, the first valve means being adapted to permit fluid to pass from the first to the second zone on the piston being displaced towards the inlet and to prevent fluid passing between the zones on the piston moving towards the outlet;

second valve means associated with the inlet, the second valve means being adapted to permit fluid flow into the first zone through the inlet on the piston being displaced towards the outlet, and to prevent fluid flow from the first zone through the inlet on the piston being displaced towards the inlet;

actuating means for displacing the piston towards the outlet; and bias means for biasing the piston towards the inlet.

The actuating means may include an elongate member as hereinbefore described.

According to a third aspect of the invention, there is provided a borehole pump, which comprises an elongate upright housing defining a pump chamber and having an inlet to the chamber at its operatively upper end as well as an outlet from the chamber, with the outlet being spaced from the inlet;

a piston displaceable along the housing towards and away from the outlet while engaging sealingly against the inside of the housing, with the inlet being located between the piston and the outlet;

a piston rod extending from the piston through an opening in the pump housing on a zone remote from the operatively upper end of the housing;

a connecting member leading from the piston rod outside the pump housing and to which an elongate actuating or reciprocating member is connectable;

first valve means associated with the outlet and adapted to permit water to pass from the pump chamber through the outlet on the piston being displaced towards the outlet and to prevent fluid from passing back into the pump chamber via the outlet on the pump being displaced away from the outlet;

second valve means associated with the inlet and adapted to permit fluid flow into the chamber through the inlet on the piston being displaced away from the outlet, and to prevent fluid flow from the chamber through the inlet on the piston being displaced towards the outlet; and bias means for biasing the piston away from the outlet.

According to a fourth aspect of the invention, there is provided anchoring means for anchoring a borehole pump in position in a borehole, the anchoring means comprising an anchoring component for holding the borehole pump at a desired position in a borehole, and attachment means fast with the anchoring component, for attaching the anchoring component to the pump.

In one embodiment of the invention, the anchoring component may comprise at least one gripping member movable from a retracted to an extended configuration in which it can grip a borehole wall, and vice versa; with the anchoring means also comprising actuating means for moving the gripping member from its extended to its retracted position, and a lever arrangement pivotally secured to the attachment means and the gripping member so that, in use, the gripping member can move from its retracted to its extended configuration under gravity when the actuating means is released.

According to a fifth aspect of the invention, there is provided water pressurizing means attachable to a borehole casing above a water take-off in the casing, the pressurizing means comprising an elongate housing connectable to the borehole casing so that it extends upwardly;

a cylindrical surface within the housing and defining a water chamber;

a sleeve located with clearance within the water chamber so that an annular space is defined between the sleeve and the cylindrical surface, with the sleeve being movable longitudinally with respect to the housing and the cylindrical surface, the operatively upper end of the sleeve being attachable to a reciprocating drive member, and the sleeve being capable of receiving and holding captive the one end of a flexible elongate member extending through the casing down a borehole; and a piston attached to the sleeve and engaging the cylindrical surface sealingly yet slidingly.

In one embodiment of the invention, the cylindrical surface may be provided on the housing which is hence also of cylindrical form.

In another embodiment of the invention, the pressurizing means may include a cylindrical member around the sleeve with the cylindrical surface being provided by the cylindrical member, the cylindrical member being located with annular clearance from the housing and the water chamber being in communication with the annular space between the cylindrical member and the housing at or near the operatively lower end of the cylindrical member, the pressurizing means also including a second cylindrical housing extending alongside the other or first housing and being in communication therewith at or near the operatively upper end of the first housing; a cylindrical surface within the second housing and defining a second water chamber; a piston within the second water chamber and engaging the cylindrical surface of the second water chamber sealingly yet slidingly; and a piston rod extending from the piston through the operatively lower end of the second housing and being connected to the sleeve such that, as the sleeve moves the piston within the first housing from an operatively lower position to a higher position, the piston within the second housing is also moved from an operatively lower to a higher position.

According to a sixth aspect of the invention, there is provided water pressurizing means attachable to a borehole casing above a water take-off in the casing, the pressurizing means comprising a first elongate housing connectable to the borehole casing so that it extends upwardly;

a cylindrical member located with annular clearance within the housing and having an inner cylindrical surface defining a first water chamber, with the first water chamber being in communication with the annular space between the housing and the member at or near the operatively lower end of the member;

an elongate actuator extending with annular clearance along the water chamber and protruding from the operatively upper end of the first housing so that an annular space is defined between the actuator and the cylindrical surface of the cylindrical member, with the operatively upper end of the actuator being attachable to a reciprocable drive member and its operatively lower end being attachable to the upper end of an elongate borehole pump actuating member extending along the casing;

a first piston attached to the actuator and engaging the cylindrical surface sealingly yet slidingly;

a second cylindrical housing extending alongside the other or first housing and being in communication therewith at or near the operatively upper end of the first housing;

a cylindrical surface within the second housing and defining a second water chamber;

a piston within the second water chamber and engaging the cylindrical surface of the second water chamber sealingly yet slidingly; and a piston rod extending from the second piston through the operatively lower end of the second housing and being connected to the actuator such that, as the actuator moves the first piston within the first housing from an operatively lower position to a higher position, the second piston within the second housing is also moved from an operatively lower to a higher position.

The actuator may be in the form of a sleeve as hereinbefore described.

The invention will now be described by way of example with reference to the accompanying diagrammatic drawings, in which FIG. 1 shows a longitudinal sectional view of a borehole pumping installation according to the invention, with part of the installation shown from the side;

Figure 1:
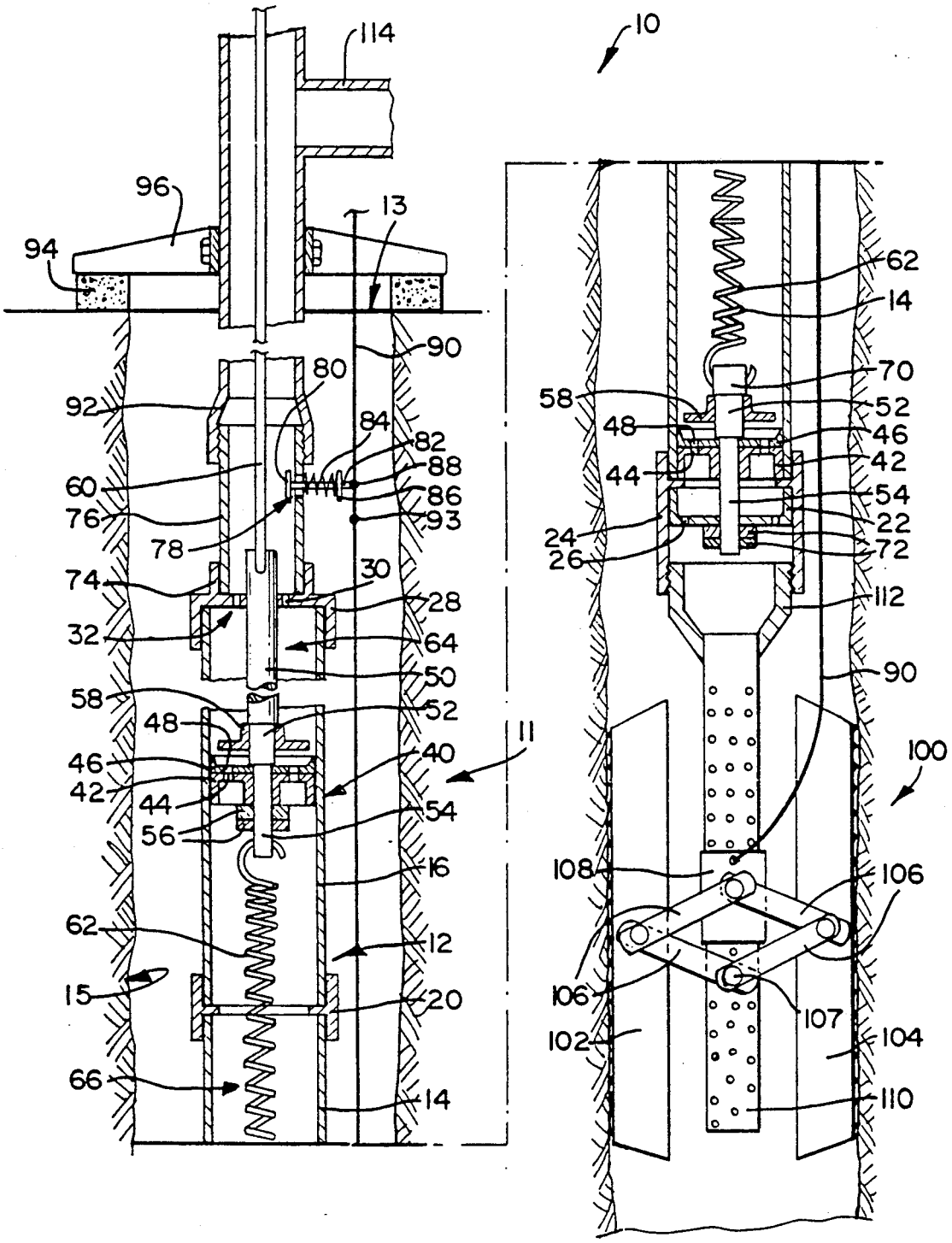

Referring to FIG. 1, reference numeral 10 generally indicates a borebole pumping installation according to the invention.

The installation 10 includes a pump, generally indicated by reference numeral 11. The pump 11 is located in a borehole 13, and includes a cylindrical pump housing or casing 12. The casing 12 comprises an operatively lower cylindrical casing section 14, as well as an upper cylindrical casing section 16. The sections 14, 16 are connected together by means of a sleeve or ring 20. Typically, the section 16 is of a more noble substantially non-corrosive metal, such as copper, than the section 14, which need only be of a metal such as galvanized steel. Instead, the casing 12 can be of unitary construction, if desired. The casing can also be of plastics material such as polyethylene, polypropylene, or nylon such as glass fibre reinforced nylon, as can be most of the other components of the installation 10. Typically, the sleeve 20 is provided with internal screw thread formations, and the ends of the casing sections with complementary external screw thread formations.

The lower end of the casing 12 is closed off with an end cap 22, the end cap 22 having external screw thread formations which engage complementary internal screw thread formations of a sleeve 24 which also has threads engaging complementary external threads at the lower end of the casing section 14. The end cap 22 is provided with circumferentially spaced water inlet openings 26.

The operatively upper end of the casing 12 is closed off with an end cap 28, the end cap having an internal screw thread which engages an external screw thread around the upper end of the casing section 16. The end cap 28 is provided with a plurality of circumferentially spaced water outlet openings 30, as well as a central aperture 32, the purpose of which will be described in more detail hereunder.

The pump 11 also includes a piston, generally indicated by reference numeral 40, displaceably located within the section 16 of the casing 12. The piston 40 comprises a circular component 42 provided with a central bore, as well as a plurality of circumferentially spaced apertures 44, with the component 42 being located slidingly within the casing section 16. On top of the component 42 is located a washer 46 of suitable sealing material, such as plastics or rubber material, with the washer 46 also having a plurality of circumferentially spaced apertures 48 which are aligned with the apertures 42. Instead of the washer 46, the component 42 can be provided with a circumferential groove (not shown) in which is located an o-ring (not shown) which then acts as the piston sealing member.

The pump 11 also includes an axially extending stainless steel rod 50 connected to the piston 40 as hereinafter described. The rod 50 has stepped portions 52, 54 of progressively smaller diameter. The stepped portion 54 extends through the central bores in the washer 46 and the component 42 in the casing section 16, and is secured in position by means of nuts 56 which engage external threads around the rod portion 54. Thus, as a result of the stepped portion 52 abutting against the top of the washer 46, the washer is held firmly in position against the component 42.

Around the stepped portion 52 of the rod 50 is slidingly located a closure or valve member 58. The valve member 58 can move freely along the stepped portion 52 of the rod, and thus closes off the washer openings 48 when it is in its lowermost position.

The upper end of the rod 50 extends slidingly through the central opening 32 in the end cap 28, and an elongate member in the form of a cable 60 is secured thereto. The cable 60 is flexible but non-elastic or non-extensible. A spring 62 depends from the lower end of the rod 50, i.e. from its stepped portion 54.

The components of the piston 40 may also be of relatively noble non-corrosive metal, such as copper.

A first zone 64 is defined between the piston 40 and the end cap 28, while another zone 66 is defined between the piston 40 and the end cap 22.

At the lower end of the casing section 14 is located a further component 42 having circumferentially spaced apertures 44, and a washer 46 having circumferentially spaced apertures 48. A rod 70, similar to the rod 50 in that it has stepped portions 52, 54 is also provided, with the stepped portion 54 thereof passing through the bores in the washer 46 and the component 42 at the lower end of the casing section 14, as well as through the end cap 22. The rod end 54 is secured in position by means of nuts 72. A closure or valve member 58 is slidable along the stepped portion 52 of the rod 70 and is adapted to close off the aligned openings 48, 44 in the components 46, 42 at the lower end of the casing section 14. The spring 62 is attached to the upper end of the rod 70. The spring 62 is adapted to bias the piston 40 downwardly.

Thus, the piston 40 is displaceably located within the pump casing 12, while the assembly of the components 42, 46 and 70 at the lower end of the casing is fixed and non-displaceable.

A socket formation 74 protrudes upwardly from the end cap 28 and is provided with an internal screw thread formation, into which is screwed a sleeve 76. The sleeve 76 is provided with an aperture 78 which is closed off by a valve member 80 from which protrudes a stem 82. The valve member 80 is biassed to a closed position by means of a spring 84 acting against the sleeve 76 around the aperture 78 as well as against a stop 86 protruding from the stem. The free end of the rod 82 is provided with an eye 88 through which extends a flexible elongate member 90 which may be a thin cable or the like. The cable 90 is provided with a protrusion 93 which cannot pass through the eye 88.

To the upper end of the sleeve 76 is attached the lower end of a flexible plastics water conduit or casing 92 extending up the borehole 13, with the cable 60 extending up the inside of the casing 92. At ground level, an annular concrete base 94 is provided around the upper opening of the borehole, and a clamp formation 96 is provided around the casing 92 and rests on the base 94. The clamp member 96 serves to anchor the casing 92 in position after the pump has been located in the borehole and the casing drawn taught, so that the casing extends more-or-less vertically up the borehole.

The installation 10 also includes anchoring means, generally indicated by reference numeral 100, for anchoring the pump in the borehole. The anchoring means 100 comprises a pair of elongate gripping members 102, 104 attached, by means of a plurality of levers 106 to each other, to a sleeve 108 and to an apertured conduit 110 at 107. The sleeve 108 is located slidingly around the apertured conduit 110, the lower end of which is closed off. The upper end of the conduit 110 is provided with a flared portion 112 which has an external screw thread formation which engages the internal screw thread formation of the sleeve 24, thereby attaching the anchoring means 100 to the pump 11. The apertured pipe 110 thus serves as a filter for water drawn into the pump 11. The conduit 110, and hence the sleeve 108, can be square or circular in cross-section.

The lower end of the cable 90 is secured to the sleeve 108.

The casing 92, above ground level, is provided with a water take-off 114, while the upper end of the cable 60 is attached to reciprocating drive means, such as a rod protruding downwardly from a windmill (not shown).

In use, to erect the installation 10, the pump 11, with the anchoring means 100, casing 92, cable 60 and cable 90 attached thereto, is lowered down the borehole 13 with the gripping members 102, 104 in a retracted position. This is achieved by pulling upwardly on the cable 90 so that the sleeve 108 slides upwardly along the pipe 110 thereby drawing the gripping members 102, 104 closer to the pipe 110. On reaching its desired position in the borehole, the cable 90 is released so that the gripping members 102, 104 then move into their operative positions as indicated in the drawing, under gravity, to engage the borehole wall 15. Thereafter the casing 92 is drawn taut as hereinbefore described, thereby causing the gripping members 102, 104 to engage the borehole wall 15 more firmly, whereafter the casing 92 is secured in position by means of the clamp 96 as hereinbefore described.

On actuation of the windmill, the rod 50 is drawn upwardly, during the upstroke or pump stroke of the windmill rod, by means of the cable 60, thereby causing the valve member 58 in the casing section 16 to close off the openings 48, 44 in the washer 46 and component 42, respectively, of the casing section 16. Water within the zone or compartment 64 is thus urged upwardly through the apertures 30 and along the casing 92. At the same time, the valve member 58 in the casing section 14 will unseat from the washer or seal 48 causing water to be drawn into the compartment 66 through the apertured pipe 110, and the openings 26, 44 and 48 in the components 22, 42, and 46, respectively, at the lower end of the casing section 14. During the downstroke of the windmill, the spring 62 will urge the piston 40 downwardly, thereby causing the valve member 58 in the casing section 16 to unseat and water to pass from the compartment 66 into the compartment 64 through the openings 44, 48 in the component 42 and washer 46, respectively, of the casing section 16. At the same time the valve member 58 in the casing section 14 will be urged to close the openings 48, 44 in the washer 46 and component 42, respectively, at the lower end of he casing 12, i.e., at the lower end of the casing section 14. Thus, during the downstroke, the compartment 66 decreases in volume, while the compartment 64 increases in volume.

Instead of the anchor means 100, alternative anchor means such as a plurality of annular weighting members (not shown) located around the housing 12, may be used.

Instead of the windmill, any other suitable reciprocating drive means such as a pivotal lever arrangement or a reciprocating motor, located above ground, may be used.

The Applicant believes that with the installation 10, the normal steel pump rod used in borehole installations can be replaced with the flexible cable 60. The cable 60 can typically comprise a steel core which is plastics coated, while the cable 90 can typically be a length of nylon cord. Furthermore, the galvanized iron steel pipeline used in borehole pumping installations, can be replaced by the flexible plastics casing 92, also resulting in a weight saving as well as in lower capital costs. The plastics casing will not be subject to corrosion, and hence costs, inconvenience and time experienced in replacing pipe casings are avoided or at least reduced. It is also easier and cheaper to install initially than known installations, e.g. the casing 92 can be installed in one length instead of in separate sections as is the case with galvanized piping.

In addition, in known installations in which a steel pump rod acts in a galvanized iron casing, bits of metal and/or rust are dislodged by the action of the steel rod on the casing. These particles fall down the casing and enter the pump casing leading to failure of the valves or excessive erosion thereof. This problem is also reduced with the installation 10 utilizing the plastics casing and plastics coated cable. In addition, the casing 92 will be subjected to very little wear since the cable 60 is plastics coated.

The installation 10 is also much quieter than known installations since the action of plastic-on-plastic or metal-on-plastic is virtually noiseless as compared to metal-on-metal.

The flexible member 60 also permits the windmill to be located remotely from the borehole if necessary, e.g. by using pulleys. A single windmill can thus also be connected to a plurality of boreholes as a result of the flexible member 60.

Since the casing, pump, etc can be removed rapidly and easily as hereinbefore described, they can be relocated easily and quickly, e.g. in another borehole. Thus, no metal casing, which can rust, remains in unused boreholes.

As regards the pump 11, the piston 40 only acts on one part thereof, i.e. the upper casing section 16. Thus, the life of the pump 11 can easily be extended by swopping the sections 14, 16.

When it is desired to withdraw the pump 11 from the borehole, e.g. for maintenance thereof, this can easily be done by urging the cable 90 upwardly. This causes the gripping members 102, 104 to move to their retracted positions as hereinbefore described. At the same time, the protrusion 93 engages the eye 88 of the valve stem 82, thereby urging the valve stem upwardly and unseating the valve 80 from the casing wall around the aperture 78. This will cause the head of water in the casing 92 to flow through the opening 78 into the borehole, thereby reducing the load to be lifted up the borehole.

In another embodiment of the invention (not shown), the anchoring means 100 may be replaced by an inflatable ring located around the casing or cylinder 12, with the cable 90 being replaced by a flexible plastics conduit extending up the borehole. By passing pressurized air or the like along the conduit, the ring can then be inflated to engagement with the borehole wall, thereby to anchor the pump in position.

In yet another embodiment of the invention (not shown), a further sleeve 108, located below the other sleeve 108, can be provided, with the pivotal connection 107 then being effected to this sleeve instead of to the pipe 110. A flange or the like (not shown) will then be provided at the lower end of the pipe 110 to prevent the sleeves sliding off. If desired, more than two of the gripping formations 102, 104 may be provided, e.g. three such formations. They will then be spaced equidistantly apart, and each will be pivotally attached to each of the sleeves, e.g. by means of a lever pivotally located between a pair of cheek plates protruding from the sleeve.

Figure 2:
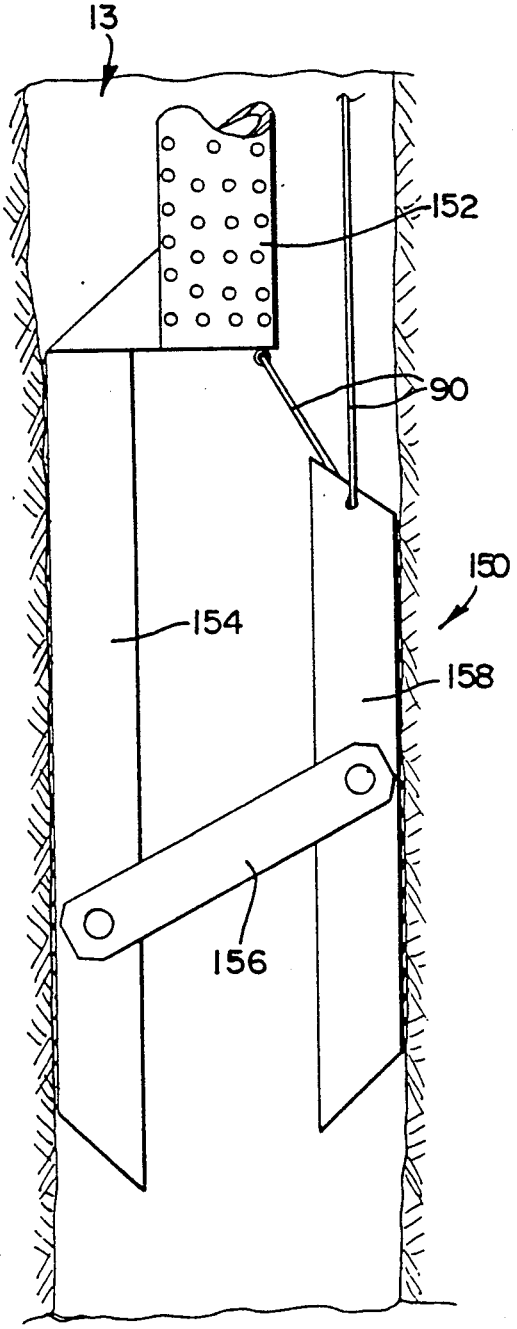
FIG. 2 shows a side view of another embodiment of anchoring means for use in the installation of FIG. 1.

Referring to FIG. 2, yet a further alternative anchoring means is shown, and is generally indicated by reference numeral 150.

The anchoring means 150 comprises a length of apertured pipe 152 which is secured to the lower end of the pump 11, as hereinbefore described. The pipe 152 is hence similar to the conduit 110. To the lower end of the pipe 152 is fixedly attached a gripping member 154. To the gripping member 154 is pivotally attached, by means of a lever 156, a further gripping member 158, so that the gripping members 154, 158 are located opposite each other. Typically, the gripping face of the member 158 is provided with suitable formations such as grooves or ridges (not shown), while the gripping face of the member 154 is smooth. The lower end of the cable 90 is then attached to the bottom end of the pipe 152, passes through an aperture at the upper end of the member 158, and extends upwardly up the borehole. By urging the cable 90 upwardly, the gripping member 158 is then moved from its extended or operative configuration as shown in FIG. 2, to a retracted configuration in which it does not engage the borehole wall, thereby permitting the pump to be withdrawn from the borehole.

The gripping members 154, 158 may be fairly long, e.g. in the order of 0.5 m to ensure that they extend vertically along the borehole and thus does not grip the borehole wall at an angle.

Figure 3:
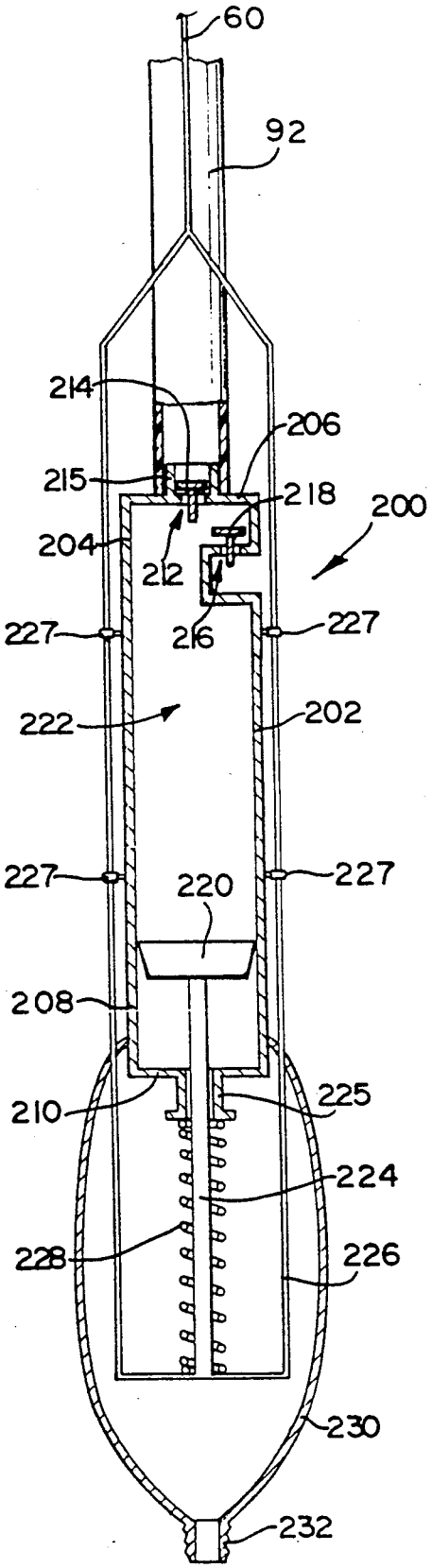
FIG. 3 shows a longitudinal sectional view of another version of a borehole pump which can be used in the installation of FIG. 1.

Referring to FIG. 3, reference numeral 200 generally indicates an alternative version of a pump which can be used with the borehole assembly 10 instead of the pump 12.

The pump 200 includes a generally circular upright elongate housing 202 which thus has an operatively upper end 204 closed off with an end cap 206, as well as an operatively lower end 208 closed off with an end cap 210. A water outlet opening 212 is provided in the end cap 206, with this opening being adapted to be closed off with a closure member or valve 214 which is guidingly located within a sleeve-like formation 215 protruding from the end cap 206.

A water inlet opening 216 is provided in the housing 202, with a buoyant closure member or valve 218 for this opening being provided.

A piston 220 moves slidingly in a reciprocating fashion along the inside of the housing 202 so that a chamber 222 is defined between the end cap 206 and the piston 220.

A piston rod 224 depends downwardly from the piston 220 through a central passageway in the end cap 210, and is guidingly located in a sleeve-like portion 225 protruding from the end cap 210. Connecting means in the form of a stirrup 226 is attached to the lower end of the rod 224 with the stirrup extending upwardly alongside the housing 202, through guides 227 protruding from the housing 202.

The flexible cable 60 is connected to the upper end of the stirrup 226. In this case, the cable 60 is located alongside, rather than in, the casing 92. A spring 228, which is similar to the spring 62 of the pump 11, is located between the sleeve 225 and the stirrup 226 and performs the same function, i.e. urges the piston 220 downwardly.

A further stirrup 230 depends downwardly from the casing 202, and is provided with a screwed socket portion 232 to which can be attached anchoring means as hereinbefore described.

The Applicant believes that with the pump 200, water can be pumped to substantial heights above ground level, without the use of pressurizing means as hereinafter described.

Figure 4:
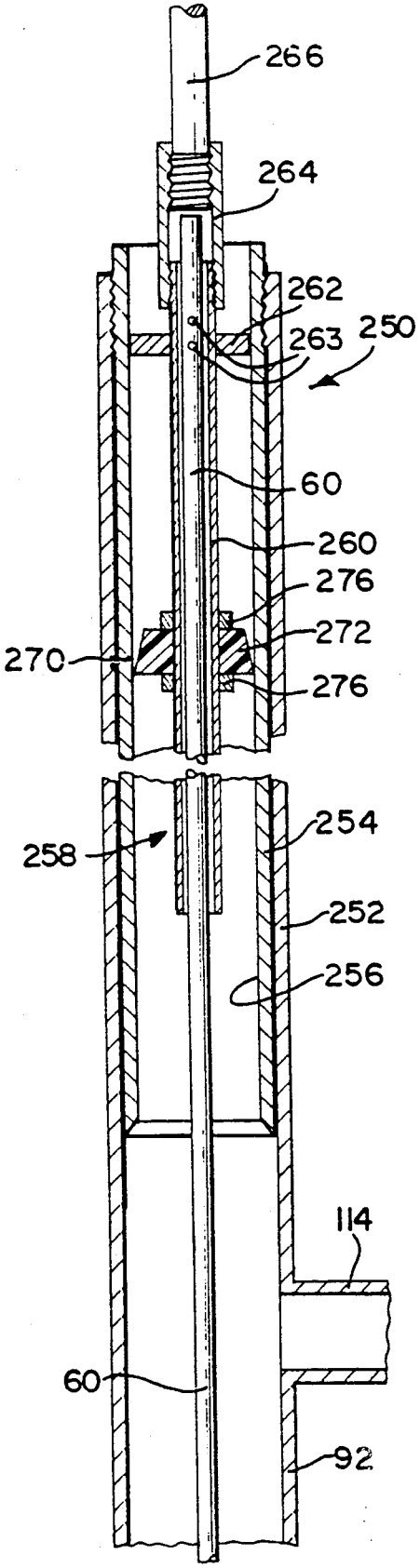
FIG. 4 shows a longitudinal sectional view of water pressurizing means which can be used with the installation of FIG. 1.

With reference to FIG. 4, the upper end of the casing 92, i.e. above the water take-off 114, can be provided with water pressurizing means, generally indicated by reference numeral 250.

The pressurizing means 250 comprises an elongate housing 252 connected to the borehole casing 92. The housing 252 can thus be an extension of the casing 92 and be of the same diameter. Within the casing 252 is located in abutting relationship a cylindrical member 254, with the cylindrical member 254 having, at its upper end, an external screw thread formation which engages an internal screw thread formation at the upper end of the housing 252. The cylindrical member 254 provides a cylindrical surface 256 within the housing, and defines a water chamber 258.

A sleeve 260 is located with annular clearance within the water chamber 258 and extends axially along the housing 252. The sleeve moves guidingly through a guide ring 262 located at the upper end of the cylindrical member 254 and is secured, at its upper end, to a sleeve 264 by means of screw thread formations. The upper end of the cable 90 extends upwardly through the sleeve 260 and is secured to the sleeve 260 by means of grub screws 263 or the like, while a windmill rod 266 is secured to the sleeve 264.

The pressurizing means 260 also includes a piston generally indicated by reference numeral 270. The piston 270 comprises a seal or washer 272 of resiliently flexible plastics or rubber material. The washer 272 is located in position by means of nuts 276 which engage threads on the outside of the sleeve 260.

During the upstroke of the pump rod 266, water naturally accumulates in the water chamber 258. During the downstroke of the pump rod 266 the column of water in the water chamber 258 can be forced downwardly through the action of the sleeve 260 and the washer 272 so as to impart a pressure or load on water flowing along the take-off 114.

By means of the sleeve 260, the stroke of the pressurizing means can be adjusted easily since the relative position of the sleeve 260 along the cable 60 can be adjusted by means of the grub screws 263.

It is believed that the pressurizing means 250 will be used with windmills having gears.

Figure 5:
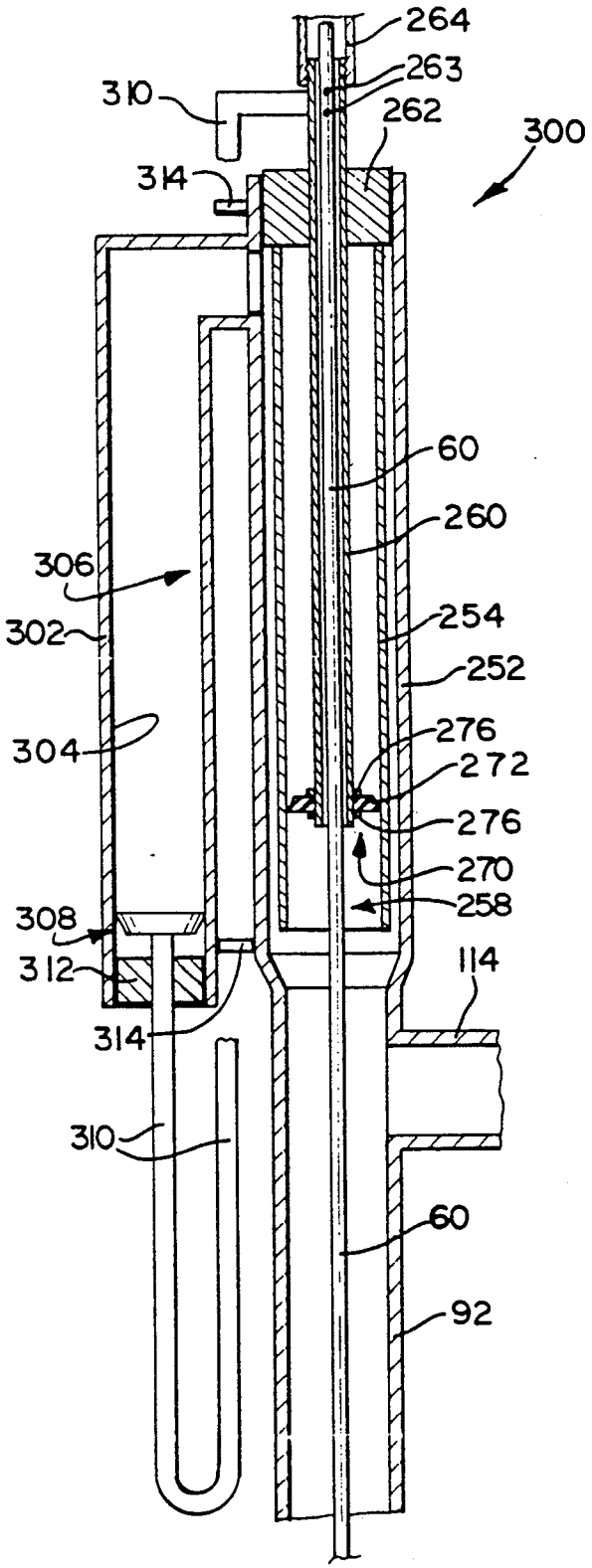
FIG. 5 shows a longitudinal sectional view of an alternative version of water pressurizing means which can be used with the installation of FIG. 1.

Referring to FIG. 5, reference numeral 300 generally indicates water pressurizing means according to another embodiment of the invention. This water pressurizing means will find particular, but not necessarily exclusive, application in windmills without gears to pump water to substantial heights In the pressurizing means 300, parts which are the same or similar to those of the pressurizing means 250, are indicated with the same reference numerals.

The pressurizing means 300 includes a second cylindrical housing 302 extending upwardly alongside the housing 252, with a cylindrical surface 304 being provided by the cylindrical housing 302, and a second water chamber 306 being defined within the housing 302. A piston 308, similar to the piston 270, is provided within the housing 302, save that the piston 308 is of opposite hand to the piston 270. A U-shaped piston rod 310 depends downwardly from the piston 308, and passes through a guide 312 at the lower end of the housing 302 The piston rod extends upwardly through guides 314 located between the housings and is attached to the upper end of the sleeve 260 where it projects above the housing 252. The housing 302 is in communication with the housing 252 at their upper ends.

In use, the pressurizing means 300 functions in a similar fashion to the pressurizing means 250 save that, on the downstroke, water is drawn into the chamber 306 while the chamber 258 is empty, while on the upstroke, as the chamber 258 is filled with water, water is urged from the chamber 306 thereby to apply continual back pressure on water flowing along the take-off 114. The diameter of the housing 306 is greater than that of the housing 258 to ensure that, with the downstroke, a positive pressure is created which overcomes frictional resistance of the pistons acting on the cylindrical surfaces.

What is claimed is:

1. A borehole pumping installation, which comprises a borehole;

a pump located down the borehole so that it is at least partially submerged in water in the borehole, the pump having a reciprocable piston or plunger such that on reciprocation of the piston or plunger, water is urged out of a pump outlet;

an elongate member connected to the piston or plunger and extending up the borehole so that, on reciprocation of the elongate member, the plunger or piston moves in reciprocating fashion;

a flexible water conduit or casing leading from the pump outlet along the borehole to the surface;

reciprocating drive means operatively connected to the elongate member; and anchoring means anchoring the pump in position in the borehole, the anchoring means comprising an anchoring component, and attachment means attaching the anchoring component to the pump, with the anchoring component comprising at least one gripping member in an extended configuration and gripping the borehole wall, the gripping member being movable from the extended configuration to a retracted configuration in which is disengages the wall; and actuating means for moving the gripping member.

2. An installation according to claim 1, wherein a plurality of the gripping members, staggered circumferentially, are provided, with the attachment means comprising at least one sleeve slidably located around a component of the pump, and connecting means connecting the gripping members to the sleeve, and with the actuating means comprising a cable extending up the borehole.

3. An installation according to claim 1, wherein the gripping member is an inflated ring around the pump, with the actuating means being a conduit leading from the ring up the borehole and through which air can be pumped into the ring to inflate it into gripping engagement with the borehole wall.

4. An installation according to claim 1, wherein (i) the casing is of plastics material; (ii) the elongate member is flexible; and (iii) the pump comprises a housing defining a pump chamber and having an inlet to the chamber as well as an outlet from the chamber, with the outlet being spaced from the inlet and the piston being located between the inlet and the outlet so that a first zone is provided in the chamber between the inlet and the piston and the second zone between the outlet and the piston, the piston being displaceable towards and away from the inlet and outlet respectively while engaging sealingly against the inside of the housing, and the piston further being displaceable towards the outlet by the elongate member;

first valve means associated with the piston, the first valve means being adapted to permit fluid to pass from the first to the second zone on the piston being displaced towards the inlet and to prevent fluid passing between the zones on the piston moving towards the outlet;

second valve means associated with the inlet, the second valve means being adapted to permit fluid flow into the first zone through the inlet on the piston being displaced towards the outlet, and to prevent fluid flow from the first zone through the inlet on the piston being displaced towards the inlet; and bias means for biasing the piston towards the inlet.

5. An installation according to claim 4, wherein the housing is of cylindrical form, with the inlet and outlet being provided at the respective ends of the housing so that the inlet is aligned axially with the outlet, and wherein the bias means comprises of spring extending between the piston and the housing in the first zone.

6. An installation according to claim 1, wherein (i) the casing is of plastic material; (ii) the elongate member is flexible; and (iii) the pump comprises an elongate upright housing defining a pump chamber and having an inlet to the chamber at its upper end as well as an outlet from the chamber, with the outlet being spaced from the inlet, the piston being displaceable along the housing towards and away from the outlet while engaging sealingly against the inside of the housing, and the inlet being located between the piston and the outlet;

a piston rod depending downwardly from the piston through an opening in the pump housing;

a connecting member leading from the piston rod outside the pump housing and to which the elongate member is connected;

first valve means associated with the outlet and adapted to permit water to pass from the pump chamber up the flexible conduit on the piston being displaced towards the outlet and to prevent fluid from passing from the conduit back into the pump chamber on the pump being displaced away from the outlet;

second valve means associated with the inlet and adapted to permit fluid flow into the chamber through the inlet on the piston being displaced away from the outlet, and to prevent fluid flow from the chamber through the inlet on the piston being displaced towards the outlet; and bias means for biasing the piston away from the outlet.

7. An installation according to claim 1, which includes a water take-off from the casing above the borehole, and water pressurizing means attached to the casing above the water take-off, the pressurizing means comprising an elongate housing attached to the casing so that it extends upwardly;

a cylindrical surface within the housing and defining a water chamber;

a sleeve located with clearance within the water chamber so that an annular space is defined between the sleeve and the cylindrical surface, with the sleeve being movable longitudinally with respect to the housing and the cylindrical surface, the operatively upper end of the sleeve being attached to the reciprocating drive means, and the elongate member passing into the operatively lower end thereof and being held captive by the sleeve; and a piston attached to the sleeve and engaging the cylindrical surface sealingly yet slidingly, so that during the up stroke of the drive means water can enter the water chamber below the piston, with this water serving to pressurize water flowing along the take-off during the downstroke.

8. A borehole pump, which comprises a housing defining a pump chamber and having an inlet to the chamber as well as an outlet from the chamber, with the outlet being spaced from the inlet;

a piston located between the inlet and the outlet so that a first zone is provided in the chamber between the inlet and the piston and a second zone between the outlet and the piston, with the piston being displaceable towards and away from the inlet and outlet respectively while engaging sealingly against the inside of the housing;

first valve means associated with the piston, the first valve means being adapted to permit fluid to pass from the first to the second zone on the piston being displaced towards the inlet and to prevent fluid passing between the zones on the piston moving towards the outlet;

second valve means associated with the inlet, the second valve means being adapted to permit fluid flow into the first zone through the inlet on the piston being displaced towards the outlet, and to prevent fluid flow from the first zone through the inlet on the piston being displaced towards the inlet;

actuating means for displacing the piston towards the outlet; and bias means for biasing the piston towards the inlet.

9. A borehole pump according to claim 8, which includes anchoring means for anchoring the pump in position in a borehole.

10. A borehole pump, according to claim 9, wherein the anchoring means comprises an anchoring component, and attachment means attaching the anchoring component to the pump housing, with the anchoring component comprising at east one gripping member movable from a retracted to an extended configuration in which it can grip the borehole well, and vice versa; actuating means for moving the gripping member from its extended to its retracted position; and a lever arrangement pivotally connecting the attachment means and the gripping member so that, in use, the gripping member can move from its retracted to its extended configuration under gravity when the actuating means is released.

11. A borehole pump, which comprises an elongate upright housing defining a pump chamber and having an inlet to the chamber at its operatively upper end as well as an outlet from the chamber, with the outlet being spaced from the inlet;

a piston displaceable along the housing towards and away from the outlet while engaging sealingly against the inside of the housing, with the inlet being located between the piston and the outlet;

a piston rod extending from the piston through an opening in the pump housing on a zone remote from the operatively upper end of the housing;

a connecting member leading from the piston rod outside the pump housing and to which an elongate actuating or reciprocating member is connectable;

first valve means associated with the outlet and adapted to permit water to pass from the pump chamber through the outlet on the piston being displaced towards the outlet and to prevent fluid from passing back into the pump chamber via the outlet on the pump being displaced away from the outlet;

second valve means associated with the inlet and adapted to permit fluid flow into the chamber through the inlet on the piston being displaced away from the outlet, and to prevent fluid flow from the chamber through the inlet on the piston being displaced towards the outlet; and bias means for biasing the piston away from the outlet.

12. A borehole pump according to claim 11, which includes anchoring means for anchoring the pump in position in a borehole.

13. A borehole pump according to claim 12, wherein the anchoring means comprises an anchoring component, and attachment means attaching the anchoring component to the pump housing, with the anchoring component comprising at least one gripping member movable from a retracted to an extended configuration in which it can grip the borehole well, and vice versa; actuating means for moving the gripping member from it extended to its retracted position; and a lever arrangement pivotally connecting the attachment means and the gripping member so that, in use, the gripping member can move from its retracted to its extended configuration under gravity when the actuating means is released.

14. Anchoring means for anchoring a borehole pump in position in a borehole, the anchoring means comprising an anchoring component, and attachment means fast with the anchoring component, for attaching the anchoring component to the pump, with the anchoring component comprising at least one gripping member movable from a retracted to an extended configuration in which it can grip a borehole wall, and vice versa; actuating means for moving the gripping member from its extended to its retracted position; and a lever arrangement pivotally connecting the attachment means and the gripping member so that, in use, the gripping member can move from its retracted to its extended configuration under gravity when the actuating means is released.

15. Water pressurizing means attachable to a borehole casing above a water take-off in the casing, the pressurizing means comprising an elongate housing connectable to the borehole casing so that it extends upwardly;

a cylindrical surface within the housing and defining a water chamber;

a sleeve located with clearance within the water chamber so that an annular space is defined between the sleeve and the cylindrical surface, with the sleeve being movable longitudinally with respect to the housing and the cylindrical surface, the operatively upper end of the sleeve being attachable to a reciprocating drive member, and the sleeve being capable of receiving and holding captive the one end of a flexible elongate member extending through the casing down a borehole;

a piston attached to the sleeve and engaging the cylindrical surface sealingly yet slidingly;

a cylindrical member around the sleeve with the cylindrical surface being provided by the cylindrical member, the cylindrical member being located with annular clearance from the housing and the water chamber being in communication with the annular space between the cylindrical member and the housing at or near the operatively lower end of the cylindrical member;

a second cylindrical housing extending alongside the other or first housing and being in communication therewith at or near the operatively upper end of the first housing;

a cylindrical surface within the second housing and defining a second water chamber;

a piston within the second water chamber and engaging the cylindrical surface of the second water chamber sealingly yet slidingly; and a piston rod extending from the piston through the operatively lower end of the second housing and being connected to the sleeve such that, as the sleeve moves the piston within the first housing from an operatively lower position to a higher position, the piston within the second housing is also moved from an operatively lower to a higher position.

16. Water pressurizing means attachable to a borehole casing above a water take-off in the casing, the pressurizing means comprising a first elongate housing connectable to the borehole casing so that it extends upwardly;

a cylindrical member located with annular clearance within the housing and having an inner cylindrical surface defining a first water chamber, with the first water chamber being in communication with the annular space between the housing and the member at or near the operatively lower end of the member;

an elongate actuator extending with annular clearance along the water chamber and protruding from the operatively upper end of the first housing so that an annular space is defined between the actuator and the cylindrical surface of the cylindrical member, with the operatively upper end of the actuator being attachable to a reciprocable drive member and its operatively lower end being attachable to the upper end of an elongate borehole pump actuating member extending along the casing;

a first piston attached to the actuator and engaging the cylindrical surface sealingly yet slidingly;

a second cylindrical housing extending alongside the other or first housing and being in communication therewith at or near the operatively upper end of the first housing;

a cylindrical surface within the second housing and defining a second water chamber;

a piston within the second water chamber and engaging the cylindrical surface of the second water chamber sealingly yet slidingly; and a piston rod extending from the second piston through the operatively lower end of the second housing and being connected to the actuator such that, as the actuator moves the first piston within the first housing from an operatively lower position to a higher position, the second piston within the second housing is also moved from an operatively lower to a higher position.

* * * * *